US011802674B2

(12) United States Patent
Eichhorn et al.

(10) Patent No.: US 11,802,674 B2
(45) Date of Patent: Oct. 31, 2023

(54) LIGHTING DEVICE FOR A MOTOR VEHICLE

(71) Applicant: Hella GmbH & Co. KGaA, Lippstadt (DE)

(72) Inventors: Karsten Eichhorn, Wadersloh (DE); Markus Giehl, Jena (DE); Daniela Karthaus, Lippstadt (DE); Christian Schmidt, Paderborn (DE); Benjamin Willeke, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/661,866

(22) Filed: May 3, 2022

(65) Prior Publication Data

US 2022/0260223 A1 Aug. 18, 2022

Related U.S. Application Data

(63) Continuation of application No. PCT/EP2019/082859, filed on Nov. 28, 2019.

(51) Int. Cl.
*F21S 41/24* (2018.01)
*F21S 41/153* (2018.01)

(52) U.S. Cl.
CPC ..... *F21S 41/24* (2018.01); *F21S 41/153* (2018.01)

(58) Field of Classification Search
CPC ..... F21S 41/25; F21S 41/24; F21S 41/153; F21S 43/209
USPC ..... 362/133
See application file for complete search history.

(56) References Cited

U.S. PATENT DOCUMENTS

| | | | | |
|---|---|---|---|---|
| 2006/0087861 | A1* | 4/2006 | Tessnow | G02B 6/0073 362/555 |
| 2017/0089536 | A1 | 3/2017 | Courcier et al. | |
| 2018/0245757 | A1* | 8/2018 | Kanayama | F21S 41/255 |
| 2018/0245759 | A1* | 8/2018 | Plank | F21S 41/663 |
| 2018/0370419 | A1* | 12/2018 | Danner | B60Q 1/24 |
| 2019/0264886 | A1* | 8/2019 | Sousek | F21S 43/31 |

FOREIGN PATENT DOCUMENTS

| | | | |
|---|---|---|---|
| DE | 102014110282 | A1 | 1/2016 |
| DE | 102016111501 | A1 | 12/2017 |
| DE | 102018201466 | A1 | 8/2019 |
| EP | 2306077 | A2 | 4/2011 |
| WO | 2014121310 | A1 | 8/2014 |
| WO | 2017106891 | A1 | 6/2017 |

* cited by examiner

*Primary Examiner* — Laura K Tso
(74) *Attorney, Agent, or Firm* — Husch Blackwell LLP

(57) ABSTRACT

A lighting device is provided for a motor vehicle. The lighting device comprises at least one imaging component with at least one active surface, on which imaging elements for the generation of pixels of a light distribution are arranged matrix-like. The lighting device further comprises a light-guiding optics having at least one entry surface and one exit surface. During operation of the lighting device, the light emanating from the at least one active surface enters the light-guiding optics through the at least one entry surface and exits the light-guiding optics through the exit surface. The exit surface has a different shape and/or a different size than the at least one active surface, and/or a plurality of active surfaces and only one exit surface or a plurality of adjacent exit surfaces are provided.

14 Claims, 1 Drawing Sheet

LIGHTING DEVICE FOR A MOTOR VEHICLE

CROSS REFERENCE

This application claims priority to and is a bypass continuation of PCT Application No. PCT/EP2019/082859, filed Nov. 28, 2019, the entirety of which is hereby incorporated by reference.

FIELD OF THE INVENTION

This invention concerns a lighting device for a motor vehicle.

BACKGROUND OF THE INVENTION

A lighting device of the type mentioned above is known from DE 10 2015 120 204 A1. The lighting device described therein may be a high-resolution adaptive head-lamp comprising at least one LED array serving as an imaging component.

Headlamps with high-resolution lighting are subject to varying requirements. Depending on the type of vehicle, the headlamps used vary in their dimensions. It is therefore desirable to have lighting that can be adapted as precisely as possible to the design of the headlamp.

Well-known high-resolution light sources or image-generating elements for example spatial light modulators (SLM) such as LCD, DLP, LCoS are produced in a complex and expensive manufacturing process. Without large investments in machines and development, the dimensions of the imaging surface cannot be adapted to different requirements.

BRIEF SUMMARY OF THE INVENTION

The problem underlying this invention is the creation of a lighting device of the type mentioned above, adapted to vehicle-specific requirements.

A lighting device may comprise light-guiding optics having at least one entry surface and one exit surface, wherein during operation of the lighting device the light emanating from the at least one active surface enters the light-guiding optics through the at least one entry surface and exits the light-guiding optics through the exit surface. The exit surface may have a different shape and/or a different size than the at least one active surface. A plurality of active surfaces and only one exit surface or a plurality of adjacent exit surfaces may be provided.

Thus, for example, in a high-resolution headlamp, at least one imaging component can be installed with an active surface of a size and shape that corresponds in particular to a size and shape available on the market and produced in series, and represented via the light-guiding optics as a high-resolution luminous surface in a shape and size that is adapted to vehicle-specific requirements. It is also possible to combine several active surfaces into one exit surface or into several adjacent exit surfaces.

Here it can be provided that the exit surface or the adjacent exit surfaces have an aspect ratio which is different from the aspect ratio of the at least one active surface. The aspect ratio of one or a number of active surfaces can be adapted to different requirements via the design of the light-guiding optics. In particular, it is possible to meet specific requirements for the shape and size of the light emission of the high-resolution headlamp without having to adapt the production of the imaging components. This opens up possibilities in the design of the headlamps and saves costs at the same time.

It is possible for the lighting device to comprise a plurality of, in particular spaced-apart, imaging components each having an active surface, wherein the light-guiding optics comprises a plurality of light-guiding optical components and wherein each of the optical components is associated with one of the active surfaces so that the light emanating from the respective active surface enters the associated optical system component through an entry surface thereof, in particular wherein the light entered through the individual entry surfaces of the optical components exits through a common exit surface or a plurality of adjacent exit surfaces. In particular, the light-guiding optics can be designed in such a way that, during operation of the lighting device, the light emitted from a plurality of active surfaces exits through the exit surface, in particular wherein a plurality of active surfaces being imaged next to one another, preferably seamlessly next to one another, on the exit surface or a plurality of adjacent exit surfaces.

The light-guiding optics produce an image of each active surface of the imaging components and merge these images seamlessly into a common image. It is possible to place several imaging components separately from each other and still combine them to one image by using the light-guiding optics. The separate placement is advantageous for cooling the headlamp because the imaging components act as heat sources.

It may be provided that the at least one entry surface of the light-guiding optics is in contact with the at least one active surface. This ensures that the light emanating from at least one active surface enters the light-guiding optics or light-guiding optical components largely loss-free.

Furthermore, it may be provided that the light-guiding optics, in particular each of the light-guiding optical components, has an enlarging cross-section starting from the at least one active surface, wherein the cross-section is preferably frustoconical or frustopyramidal and the smaller diameter of the frustoconical or frustopyramidal surface faces the active surface. Due to the special shape of the light-guiding optics it is possible to close the distances between the imaging components.

Advantageously, it can be provided that the light guiding within the light-guiding optics, especially within each of the light-guiding optical components, is based on the Anderson Localization, preferably the Transversal Anderson Localization. Here, at least two optical materials with different refractive indices are arranged stochastically or randomly along two dimensions of the light-guiding optics and extend homogeneously along a third dimension. The refractive index is therefore constant in one dimension along the respective fiber and is randomized over all fibers along the other two dimensions. Thus it is possible to limit the light propagation within the light-guiding optics very precisely to a desired dimension and thus to a desired direction. In the other two dimensions almost no light propagates. The Transversal Anderson Localization ensures that light can propagate in the light-guiding optics or in the light-guiding optical components essentially only in the direction in which the entry surface and the exit surface lie opposite each other. This ensures that the arrangement of the pixels on the active surface of the imaging component largely corresponds exactly to the arrangement of the pixels on the exit surface of the light-guiding optics or light-guiding optical components. By means of a light-guiding optics designed in this way, the shape of at least one active surface can be converted into any shape while retaining the image information.

In addition, there is the possibility that the light-guiding optics, in particular each of the optical components, has at least one transparent, light-guiding material such as plastic, glass or ceramic.

It may be provided that the light-guiding optics, in particular each of the light guiding optical components, comprises a plurality of fibers, preferably the individual fibers having a cross-section smaller than 500 nm. The aim is to achieve a cross-section of the individual fibers that is smaller than the wavelength of the visible light. The wavelength of visible light lies in the range from 380 nm to 780 nm. Due to a fiber cross section smaller than 500 nm a light guiding based on the Transversal Anderson Localization is efficiently possible.

Further, it may be provided that the light-guiding optics, in particular each of the optical components, comprises a plurality of first fibers having a first refractive index and a plurality of second fibers having a second refractive index different from the first refractive index. The fibers, which in particular alternate with each other, correspond to the two transparent, light-guiding materials with different refractive indices. Preferably the difference of the refractive indices is as large as possible.

In this case it may be provided that the first and second fibers are arranged randomly side by side in transverse directions, the transverse directions being perpendicular to the direction of propagation of the light propagating from the at least one entry surface to the exit surface.

Furthermore, it is possible that the light-guiding optics, in particular each of the optical components, has at least two different transparent light-guiding materials. The materials can be materials such as plastic, glass or ceramics. In another version, the second material is air with a refractive index of 1. By using air as the second material, two different materials are used in a simple form. This can also ensure that the difference between the refractive indices is as large as possible.

In addition, it may be provided that the light guiding optical system, in particular each of the optical components, is manufactured by compressing, heating and drawing the plurality of first and second fibers or a plurality of first fibers with air inclusions in random arrangement so that by fusing the different fibers or the fibers with air inclusions a mixed light guiding material with at least two different refractive indices is formed. By heating and drawing, the cross-section of the fibers can be reduced to dimensions smaller than 500 nm. Furthermore, this results in a firm bond between the individual fibers. If only one type of fibers with air inclusions is used, the compressing, heating and drawing of the air inclusions creates elongated air ducts extending between the entry surface and the exit surface. The fibers and the air ducts are arranged stochastically or randomly. In both cases this light-guiding material shows in a special way the desired material properties for a light-guide based on the Transversal Anderson Localization. The material has a statistically varying transverse refractive index and a longitudinally constant refractive index in the direction between the entry surface and the exit surface.

It may be provided that the imaging elements on the at least one active surface are formed as light-emitting diodes or as laser diodes, in particular that the imaging component is a solid-state LED array, or that the imaging component is formed as LCoS or as LC display, or that the imaging component comprises LCoS or LC display.

It is also possible for the lighting device to include a projection optics from which the exit surface of the light-guiding optics is projected into the exterior of the vehicle during operation of the lighting device. The lighting device is preferably used in a high-resolution headlamp to illuminate the road.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

In the figures, identical and functionally identical parts are provided with the same reference signs.

Figure 1:
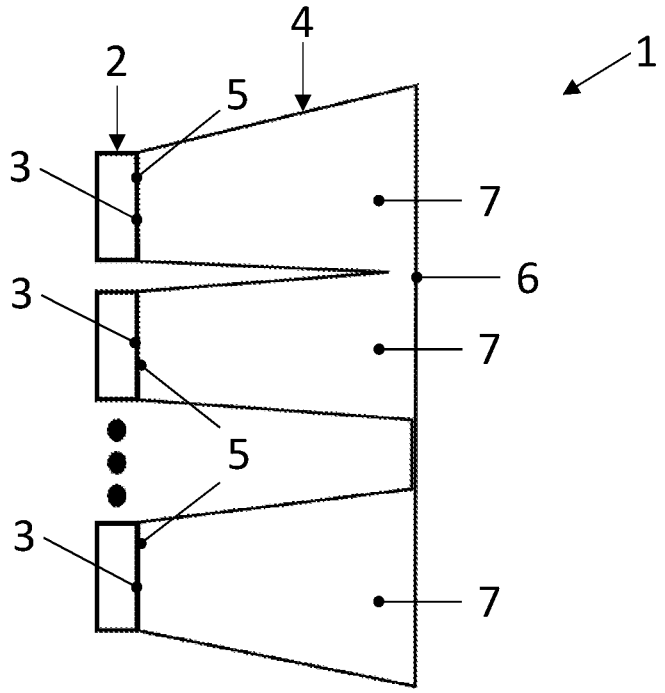
FIG. 1 is a schematic plan view of a first version of a lighting device according to an embodiment of the invention.

The design of a lighting device 1 according to the invention shown in FIG. 1 comprises a plurality of imaging components 2 each with an active surface 3 on which matrix-like imaging elements for the targeted generation of pixels of a light distribution are arranged. The imaging component 2, for example, is a solid-state LED array, so that the imaging elements of each active surface 3 are designed as light-emitting diodes (LED).

The design also includes light-guiding optics 4 with a plurality of light-guiding optical components 7, each with an entry surface 5. The optical components 7 have a common exit surface 6 on the side opposite the entry surfaces 5. However, it can also be provided that each of the optical components 7 has a separate exit surface 6, whereby these exit surfaces 6 are connected to each other.

Each of the entry surfaces 5 is adjacent to one of the active surfaces 3 of the imaging components 2. This means that one of the optical components 7 is assigned to each of the active surfaces 3, so that the light emitted from the respective active surface 3 enters it through an entry surface 5 of the assigned optical component 7. The entry surface 5 is flat in order to be able to fully abut the likewise flat active surface 3.

The light entering the light-guiding optics 4, in particular the light entering the individual entry surfaces 5 of the optical components 7, exits the light-guiding optics 4 through the common exit surface 6 or through several adjacent exit surfaces 6.

The light-guiding optics 4, in particular each of the light-guiding optical components 7, has an enlarging cross-section starting from the entry surface 5 associated with the respective active surface 3, the cross-section being frustoconical or frustopyramidal and the smaller diameter of the frustoconical or frustopyramidal facing the active surface 3. Due to the special shape of the light guiding optical system 4 it is possible that the distances between the imaging components 2 are closed. Thus, during operation of the lighting device 1, the light emitted from several active surfaces 3 can be imaged seamlessly next to each other on the exit surface 6 by the light-guiding optics 4.

This has the advantage that the imaging components 2 can be placed locally separated from each other and nevertheless a coherent image can be generated. The separate placement offers an advantage for the cooling of the lighting device 1, as better heat dissipation is possible from imaging components 2 that are placed separately from each other than from connected imaging components 2.

The light-guiding optics 4, in particular each of the optical components 7, comprise at least two different transparent light guiding materials. The materials can be materials such as plastic, glass or ceramics. Air with a refractive index of 1 can also be selected as the second material. By using air as the second material, two different materials are used in a simple form.

The light-guiding optics 4, in particular each of the optical components 7, is manufactured in such a way that the plurality of first and second fibers or a plurality of first fibers with air inclusions are compressed, heated and drawn in random arrangement so that by fusing the different fibers or the fibers with air inclusions a mixed light-guiding material with at least two different refractive indices is produced. If air is used as the second material, the compression, heating and drawing of the air inclusions creates elongated air ducts extending between the entry surface 5 and the exit surface 6. The fibers and the air ducts are arranged stochastically or randomly.

In both cases, the resulting light guiding material shows desired material properties, so that light guidance can be based on Transversal Anderson Localization.

Here, at least two optical materials with different refractive indices are arranged stochastically/randomly along two dimensions of the light-guiding optics 4 and run homogeneously along a third dimension which corresponds to the direction between the entry surface 5 and the exit surface 6. The refractive index is therefore constant in one dimension along the respective fiber and is randomized over all fibers along the other two dimensions. Thus it is possible to limit the light guidance within the light-guiding optics 4 very precisely to a desired dimension and thus to a desired direction. In the other two dimensions there is almost no propagation of light.

Due to the special type of light-guiding optics 4, it is possible to change the size and shape of the image generated by the imaging components 2. In this way, the image created on the exit surface 6 of the light-guiding optics 4 can be changed. It is particularly possible here to adapt the size to specific requirements, in particular in such a way that the dimensions optimally match the headlamp used.

Figure 2:
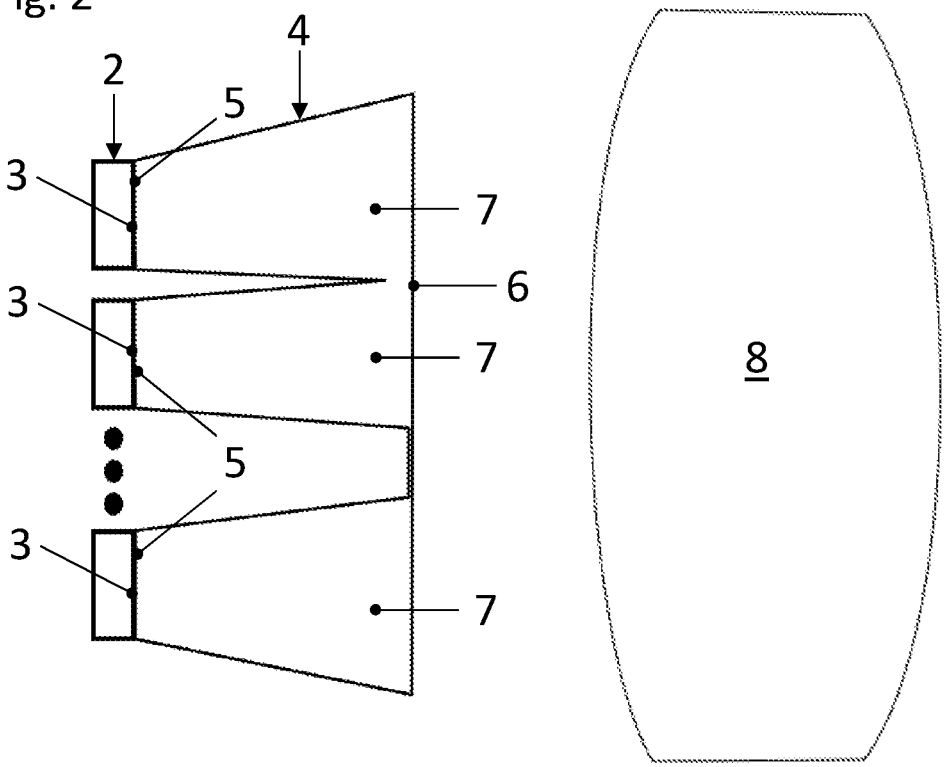
FIG. 2 is a schematic plan view of a second version of a lighting device according to another embodiment of the invention.

The design according to FIG. 2 differs from that according to FIG. 1 by an additional projection optics 8. The projection optics 8 project the combined image of the active surfaces 3 of the imaging components 2 at the exit surface 6 into the exterior of the vehicle. When the lighting device is used in a high-resolution headlamp, the lighting device serves to illuminate the road.

LIST OF REFERENCE SIGNS

1 lighting device

2 imaging component

3 active area of the imaging component

4 light-guiding optics

5 entry surface of the light-guiding optics

6 exit surface of the light-guiding optics

7 light-guiding optical component of the light-guiding optics

8 projection optics

The invention claimed is:

1. A lighting device for a motor vehicle comprising:

at least one imaging component with at least one active surface, on which imaging elements for the generation of pixels of a light distribution are arranged matrix-like;

light-guiding optics having at least one entry surface and one exit surface;

wherein the light-guiding optics comprises a plurality of fibers having a cross-section smaller than 500 nm;

wherein during operation of the lighting device, the light emanating from the at least one active surface enters the light-guiding optics through the at least one entry surface and exits the light-guiding optics through the exit surface;

wherein at least one of:

the exit surface has a different shape or a different size than the at least one active surface; and a plurality of active surfaces and only one exit surface or a plurality of adjacent exit surfaces are provided.

2. The lighting device according to claim 1, wherein the exit surface or the adjacent exit surfaces have an aspect ratio different from the aspect ratio of the at least one active surface.

3. The lighting device according to claim 1, wherein the lighting device further comprises:

a plurality of imaging components each having an active surface, wherein the light-guiding optics comprises a plurality of light-guiding optical components and wherein each of the optical components is assigned to one of the active surfaces so that the light emanating from the respective active surface enters the associated optical component through an entry surface of the associated optical component.

4. The lighting device according to claim 3, wherein during operation of the lighting device, the light emanating from a plurality of active surfaces exits through the exit surface, wherein a plurality of active surfaces being imaged next to one another on the exit surface or a plurality of adjacent exit surfaces.

5. The lighting device according to claim 1 wherein the at least one entry surface of the light-guiding optics is in contact with the at least one active surface.

6. The lighting device according to claim 1 wherein the light-guiding optics has an increasing cross-section starting from the at least one active surface, wherein the cross-section is frustoconical or frustopyramidal and the smaller diameter of the frustum of the cone or frustum of the pyramid faces the active surface.

7. The lighting device according to claim 1 wherein the light guiding within the light-guiding optics is based on the Anderson Localization.

8. The lighting device according to claim 1 wherein the light-guiding optics has at least one transparent, light-guiding material such as plastic, glass or ceramic.

9. The lighting device according to claim 1, wherein the light-guiding optics comprises a plurality of first fibers having a first refractive index and a plurality of second fibers having a second refractive index different from the first refractive index.

10. The lighting device according to claim 9, wherein the first and second fibers are arranged randomly next to each other in transverse directions, the transverse directions being perpendicular to the direction of propagation of the light propagating from the at least one entry surface to the exit surface.

11. The lighting device according to claim 1 wherein the light-guiding optics comprises at least two different transparent light-guiding materials, wherein a second of the at least two different transparent light-guiding materials being air with a refractive index of 1.

12. The lighting device according to claim 9, wherein the light-guiding optics is produced by compressing, heating and drawing the plurality of first and second fibers or a plurality of first fibers with air inclusions in random arrangement, so that by fusing the different fibers or the fibers with air inclusions a mixed light-guiding material with at least two different refractive indices is produced.

13. The lighting device according to claim 1 wherein the imaging elements on the at least one active surface are in the form of light emitting diodes or laser diodes.

14. The lighting device according to claim 1 wherein the lighting device comprises a projection optics, from which the exit surface of the light-guiding optics is projected into the exterior space of the motor vehicle during operation of the lighting device.

* * * * *